US009044645B2

(12) United States Patent
Koleoglou

(10) Patent No.: US 9,044,645 B2
(45) Date of Patent: Jun. 2, 2015

(54) GOLF BALL

(76) Inventor: Peter D. Koleoglou, Southampton, NY (US)

( * ) Notice: Subject to any disclaimer, the term of this patent is extended or adjusted under 35 U.S.C. 154(b) by 1163 days.

(21) Appl. No.: 12/587,531

(22) Filed: Oct. 8, 2009

(65) Prior Publication Data

US 2011/0039638 A1 Feb. 17, 2011

Related U.S. Application Data

(60) Provisional application No. 61/232,959, filed on Aug. 11, 2009, provisional application No. 61/240,156, filed on Sep. 4, 2009, provisional application No. 61/238,934, filed on Sep. 1, 2009, provisional application No. 61/240,160, filed on Sep. 4, 2009.

(51) Int. Cl.

| | |
|---|---|
| ***A63B 37/12*** | (2006.01) |
| ***A63B 37/00*** | (2006.01) |
| ***A63B 43/00*** | (2006.01) |
| ***A63B 45/02*** | (2006.01) |

(52) U.S. Cl.

CPC ..... *A63B 37/0004* (2013.01); *A63B 43/008* (2013.01); *A63B 37/0003* (2013.01); *A63B 45/02* (2013.01)

(58) Field of Classification Search

CPC ..... A63B 37/0022
USPC ..... 473/378, 351
See application file for complete search history.

(56) References Cited

U.S. PATENT DOCUMENTS

| | | | | |
|---|---|---|---|---|
| 4,441,716 | A | 4/1984 | Chen | |
| 5,564,707 | A * | 10/1996 | Dinh | 473/218 |
| 6,231,459 | B1 | 5/2001 | Pettigrew et al. | |
| 6,422,949 | B1 | 7/2002 | Byrne et al. | |
| 6,551,195 | B2 | 4/2003 | Byrne et al. | |
| 6,852,039 | B2 | 2/2005 | Pettigrew et al. | |
| 2002/0032076 | A1 | 3/2002 | Isogawa et al. | |
| 2002/0086741 | A1 | 7/2002 | Newcomb | |
| 2003/0054897 | A1 | 3/2003 | Crici et al. | |
| 2006/0148592 | A1 * | 7/2006 | Kruse | 473/378 |
| 2006/0293113 | A1 | 12/2006 | Pelz | |
| 2007/0026969 | A1 * | 2/2007 | Melanson et al. | 473/371 |
| 2007/0026971 | A1 * | 2/2007 | Aoyama et al. | 473/378 |
| 2007/0207874 | A1 | 9/2007 | Klein | |
| 2008/0020865 | A1 | 1/2008 | Mitsuba | |
| 2009/0066773 | A1 | 3/2009 | Kennedy, III et al. | |

* cited by examiner

*Primary Examiner* — Raeann Gorden
(74) *Attorney, Agent, or Firm* — Daniel P. Burke & Associates, PLLC

(57) ABSTRACT

The present invention is directed to a golf ball having multiple indicia for aiding a golfer in positioning the golf ball with the intended ball path. In one embodiment, the golf ball has at least three distinct primary indicia aligned on the golf ball within a quarter of the circumference of the golf ball. The primary indicia includes a first primary indicia which is spaced a first distance from a second primary indicia, and a third primary indicia which is spaced a second distance from the second primary indicia. In an embodiment, the two distances are different. In another embodiment the distances are the same. Other versions have supplemental indicia positioned between the primary indicia and/or can be positioned proximate the first and/or third primary indicia. The supplemental indicia are preferably lighter in color intensity than the primary indicia so that the primary indicia is more readily visible to a golfer when the golfer is ready to putt.

68 Claims, 10 Drawing Sheets

GOLF BALL

RELATED APPLICATION DATA

This application claims the benefit under 35 U.S.C. §119 (e) of U.S. Provisional Application Ser. No. 61/232,959 filed Aug. 11, 2009, U.S. Provisional Application Ser. No. 61/240,156 filed Sep. 4, 2009, U.S. Provisional Application Ser. No. 61/238,934 filed Sep. 1, 2009 and U.S. Provisional Application Ser. No. 61/240,160 filed Sep. 4, 2009, which are hereby incorporated by reference as if repeated herein in their entireties.

The present invention is directed to a golf ball comprising multiple indicia on the surface of the golf ball for aiding a user in putting the golf ball along an intended ball path and with the desired force.

BACKGROUND OF INVENTION

Golf balls have been provided with instructional guides on the golf ball to assist a golfer in properly putting the ball. For example, lines and phrases such as "KEEP YOUR HEAD DOWN" have been suggested for placement on golf balls to remind a golfer of certain golf tips.

SUMMARY OF INVENTION

Embodiments of the present invention are directed to a golf ball having multiple indicia for aiding a golfer in properly striking the golf ball in the desired direction and with the appropriate force while putting. One embodiment of the present invention is directed to a golf ball comprising an outer surface and at least three distinct primary indicia aligned on the golf ball within a quarter of the circumference of the golf ball. The primary indicia comprise a first primary indicia, a second primary indicia and a third primary indicia. The first primary indicia is spaced a first distance from the second primary indicia, and the second primary indicia is spaced a second distance from the third primary indicia. The distances between the first and second primary indicia and between the second and third primary indicia are different.

Another embodiment of the present invention is directed to a golf ball comprising at least three distinct primary indicia aligned on the golf ball and having different spacing as disclosed above. This embodiment further comprises supplemental indicia that is preferably positioned at least partially within the spaces between the primary indicia and/or can be positioned proximate the first primary indicia and/or the third primary indicia. The supplemental indicia are preferably lighter in color intensity than the primary indicia so that the primary indicia are more readily visibly discernible to a golfer when the ball is on the green and the golfer is positioned to putt.

Yet another embodiment of the present invention is directed to a golf ball comprising at least two sets of primary indicia aligned on the golf ball wherein one set of primary indicia are positioned opposite the other set. Each set of primary indicia have different spacing.

Another embodiment of the present invention is directed to a putting kit comprising a first golf ball comprising a first set of primary indicia having different spacing as disclosed above, and a second golf ball comprising a set of primary indicia having different spacing from the primary indicia on the first ball.

According to another embodiment, the golf ball comprises an outer surface comprising a plurality of dimples and an outer rim. At least one of the primary indicia on the golf ball of this embodiment is at least partially disposed on a dimple.

According to yet another embodiment of the present invention, the golf ball comprises at least three distinct primary indicia aligned on the golf ball. In this embodiment, the primary indicia are disposed in more than one quadrant of the golf ball.

According to yet another embodiment of the present invention, the golf ball comprises at least three distinct and evenly spaced primary indicia aligned on a circumference of the outer surface of the golf ball. In this embodiment, the primary indicia are disposed within one quadrant of the golf ball and the remaining quadrants of the golf ball lack instruction indicia.

Another embodiment of the present invention is directed to a golf ball comprising two sets of evenly spaced primary indicia aligned on the golf ball. The first set of primary indicia is disposed within one quadrant of the golf ball and the second set of primary indicia is disposed within a second quadrant of the golf ball. The first set of primary indicia are positioned opposite the second set of primary indicia.

Another embodiment of the present invention is directed to a golf ball comprising at least three distinct primary indicia aligned on a circumference of the golf ball. In this embodiment there are no other indicia on the same circumference on which the primary indicia are aligned.

Another embodiment of the present invention is directed to a golf ball comprising at least three distinct primary indicia aligned on an outer surface of the golf ball. A first primary indicia is spaced a first distance from a second primary indicia, and the second primary indicia is spaced a second distance from a third primary indicia. In this embodiment, the first distance and the second distance are at least 0.5 inches. In one embodiment, the first and second distances are the same. In another embodiment, the first and second distances are different.

Yet another embodiment of the present invention is directed to a golf ball comprising at least three primary indicia aligned on a circumference of a golf ball. A first primary indicia is spaced a first distance from a second primary indicia, and the second primary indicia is spaced a second distance from a third primary indicia. In this embodiment, at least one of the first distance or the second distance is greater than or equal to three times the length of one of the primary indicia as measured along the circumference on which the indicia are aligned. In another embodiment, both the first distance and the second distance are at least this long. In yet another embodiment, both the first distance and the second distance are at least four times the length of one of the primary indicia.

DETAILED DESCRIPTION

Figure 1:
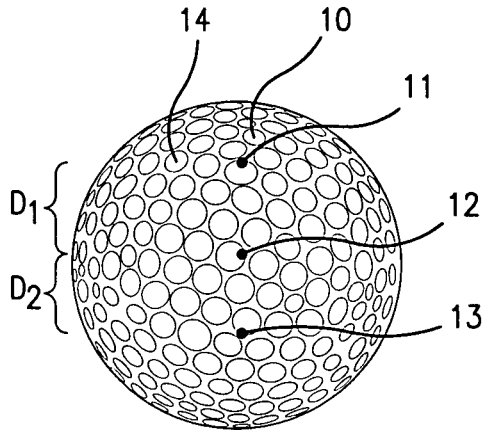
FIG. 1 is a perspective view of one embodiment of the present invention.

According to one embodiment of the present invention, as illustrated in FIG. 1, a golf ball 10 comprises separate and distinct primary indicia which are aligned on the surface of the golf ball 10. As used herein, the term "distinct primary indicia" refers to indicia that are separately discernable regardless of whether they are connected or intersected by other indicia. FIGS. 1-27 are provided for illustrational purposes. Neither the indicia nor the spacing between the indicia are intended to be accurate representations of sizes or actual distances.

The primary indicia comprise at least three indicia that are designed to be clearly visible when a golfer is standing over the golf ball 10 ready to putt. The primary indicia may comprise more than three separate and distinct primary indicia, for example, a golf ball can have four, five, or more primary indicia. The primary indicia of FIG. 1 comprise a first primary indicia 11 which is spaced a first distance $D_1$ from a second primary indicia 12, and a third primary indicia 13 which is spaced a second distance $D_2$ from the second primary indicia 12. The spacing distance $D_1$ is measured from the center of the first primary indicia 11 to the center of the second primary indicia 12, and the spacing distance $D_2$ is measured from the center of the second primary indicia 12 to the center of the third primary indicia 13. The spacing distances $D_1$ and $D_2$ are different. For example, suitable spacing distance $D_1$ can be approximately 0.5 inches, and suitable spacing distance $D_2$ can be approximately 0.4 inches. The distance between the first primary indicia and the third primary indicia can be about 0.4 inches to about 2.6 inches and is preferably about 0.7 inches to about 1.3 inches. In one illustrated embodiment, the spacing from the center of the first indicia 11 to the center of the third indicia 13 is approximately 0.8 inches. The exact measurements of the spacing distances $D_1$ and $D_2$ can be varied within the scope of the present invention.

Figure 2:
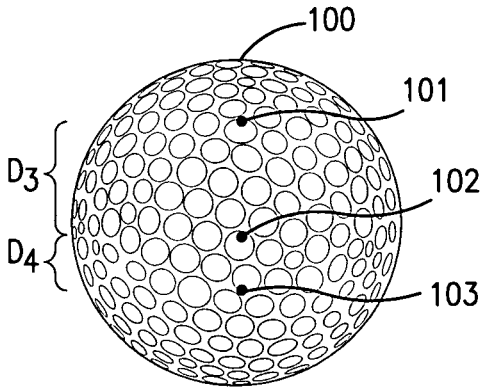
FIG. 2 is a perspective view of a second embodiment of the present invention.

FIG. 2 illustrates another embodiment of the golf ball 100 of the present invention wherein a first primary indicia 101 is spaced a first distance $D_3$ from a second primary indicia 102 and the second primary indicia 102 is spaced a second distance $D_4$ from a third primary indicia 103. Spacing distances $D_3$ and $D_4$ are different from spacing distances $D_1$ and $D_2$ described in FIG. 1.

Figure 25:
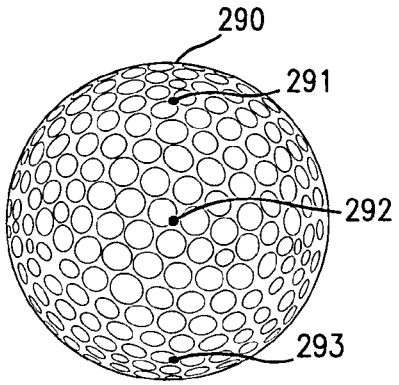
FIG. 25 is a perspective view of yet another embodiment of the present invention.

A golf ball can be considered to have four quadrants which each encompass a quarter of the circumference of the ball. As used herein, a "circumference" refers to an imaginary line on the outer surface of a ball on a plane passing through the center of the ball. The outer surface of a golf ball comprises dimples and an outer rim, as further defined below. In one preferred embodiment of the present invention, all of the primary indicia are aligned on the golf ball on one of the quadrants. The first primary indicia and the third primary indicia are most preferably aligned on the circumference within an arc of less than ninety degrees. In one embodiment, the first and third primary indicia are disposed within an arc of about twenty degrees to about eighty degrees, and preferably within an arc of about forty-five degrees to about seventy degrees. In another embodiment, the primary indicia are disposed on a golf ball in more than one quadrant. As illustrated in FIG. 25, the first primary indicia 291 and the third primary indicia 293 are disposed on the golf ball 290 within an arc of greater than ninety degrees, and approximately 165 degrees. In this illustrated embodiment, the primary indicia 291, 292 and 293 are disposed on the golf ball 290, aligned with a circumference, and within two adjoining quadrants. In another embodiment, the first primary indicia and the third primary indicia are disposed on a golf ball at a distance slightly less than half the circumference, i.e. within a distance of approximately 2.6 inches and within an arc of slightly less than 180 degrees.

Figure 5:
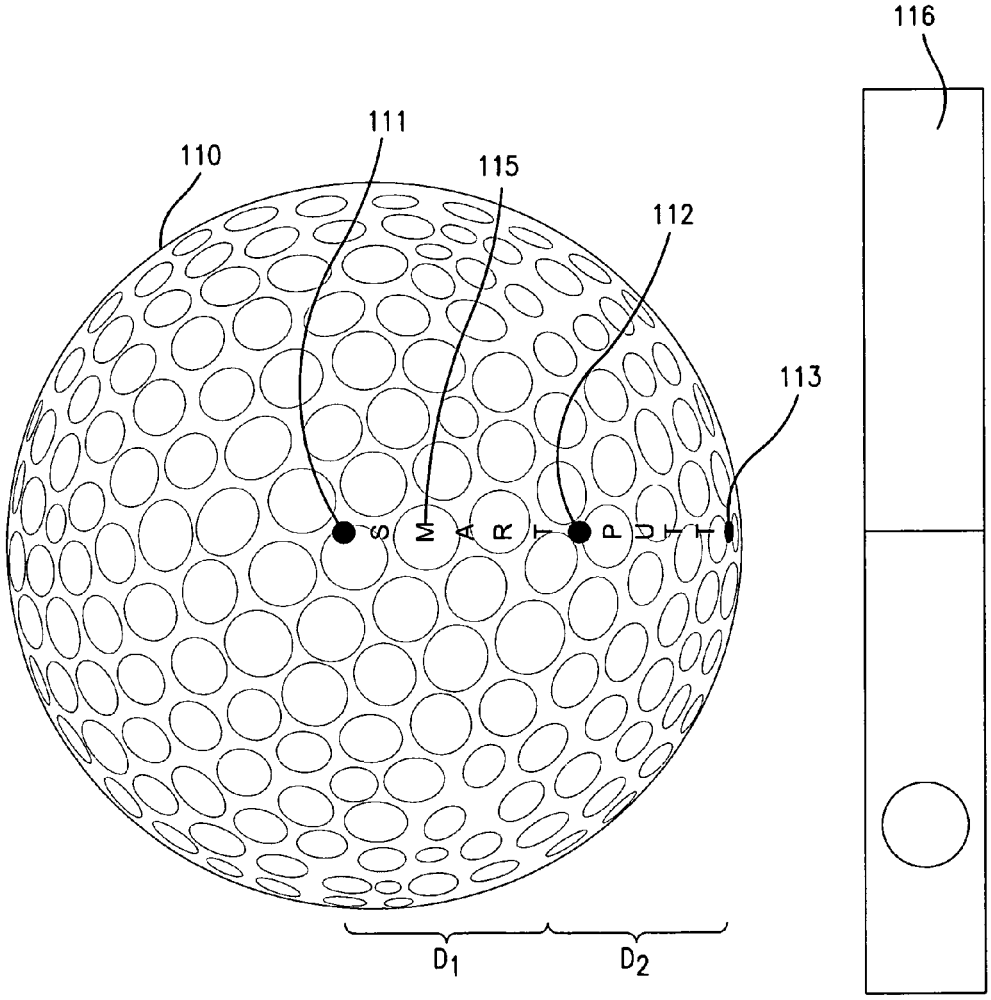
FIG. 5 is a top view of the embodiment shown in FIG. 4 with a known putter positioned to the right of the golf ball.
Figure 23:
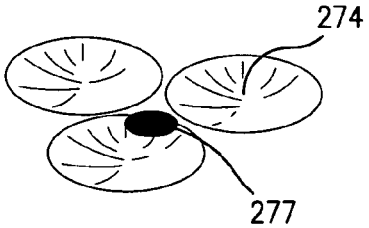
FIG. 23 is a partial close up view of the surface of a golf ball according to one embodiment of the present invention.
Figure 23A:
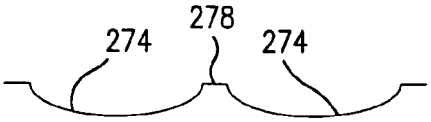
FIG. 23A is a partial cross-sectional view of two dimples of a golf ball.

The golf ball 10 has an outer surface and also comprises a plurality of dimples 14 and an outer rim. In one embodiment, at least one of the primary indicia is preferably at least partially disposed on one of the dimples. In another embodiment at least one primary indicia 277 is disposed partially in a dimple 274 and partially on the outer rim 278 of the golf ball as illustrated in FIG. 23. In another embodiment, all of the primary indicia are at least partially disposed on one of the dimples. FIG. 23A illustrates a cross-section of two dimples 274 and the outer rim 278, i.e. the space between dimples. As further discussed below and as illustrated in FIG. 5, in use, a golfer preferably rotates the ball so that the primary indicia closest to the point of contact is positioned at or very close to the point of contact. The benefit of a primary indicia being at least partially disposed on a dimple, and more preferably partially on a dimple surface facing upward and/or toward the other indicia, and also partially on the rim, is that it is easier to see by a golfer standing generally over the ball even when the ball is rotated. The primary indicia can be imprinted on the golf ball or disposed on the golf ball in any known manner, such as hot stamping, image transfer or other methods.

Figure 3:
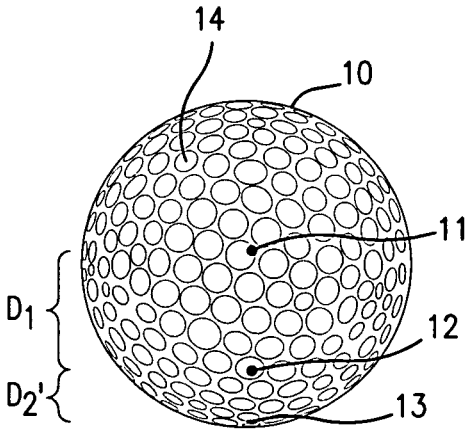
FIG. 3 is a perspective view of the embodiment illustrated in FIG. 1 with the golf ball rotated.

In use, a golfer lines up the three primary indicia 11, 12 and 13 with the intended ball path when placing the golf ball 10 on the green. As used herein, the term "intended ball path" refers to the path, preferably a straight line, that a golfer wants the golf ball to initially follow. As illustrated in FIG. 3, the ball 110 is preferably positioned with the primary indicia 111, 112, and 113 in an upper quadrant of the ball 110 and on the side which will be struck by the putter. The indicia furthest from the point of contact, where the putter strikes the ball, can also be positioned at or close to the top of the ball. Depending on the length of the putt, either the first or third indicia are preferably positioned closest to the point of contact to facilitate visibility by the golfer. The primary indicia are positioned at or more preferably slightly above the point of contact. After the golf ball 110 is placed on the green and when the golfer is standing over the golf ball 110 ready to putt, the golfer's eyes preferably focus primarily on the two primary indicia 112 and 113 closest to the point of contact. The golfer preferably thinks of the primary indicia as objects, akin to billiard balls, wherein the primary indicia closest to the point of contact is hit into the next closest primary indicia, theoretically causing that "next closest primary indicia" to strike a primary indicia furthest from the point of contact.

The spacing between the three primary indicia is also designed to assist a golfer in determining the appropriate force with which to strike the golf ball for making a putt of various distances, i.e. a shorter putt versus a longer putt. The golfer can also adjust the perceived distance between two of the primary indicia, preferably the two primary indicia closest to the point of contact, in order to adjust the visual indication she perceives with the amount of force with which to strike the ball. The perceived spacing distances $D_1$ and $D_2$ give a golfer a visual impression of how much force the golf ball 10 should be struck with in order to get from the starting ball position to the cup. As illustrated in FIG. 3, due to the curvature of the ball 110, the two primary indicia 112 and 113 closest to the point of contact will be perceived as being closer than their actual spacing by a golfer standing over the ball 110. The perceived distance between primary indicia 112 and 113 is identified as $D_2'$.

Figure 6:
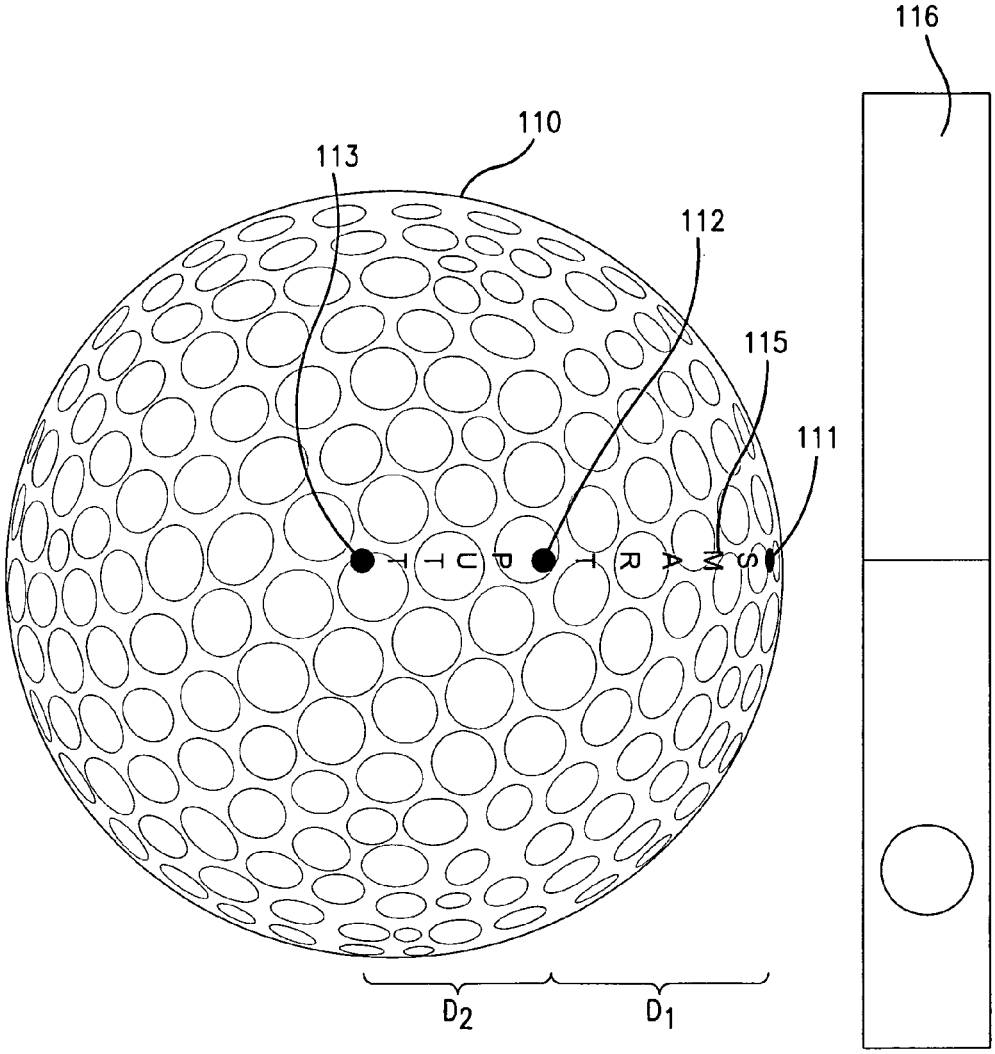
FIG. 6 is a top view of the embodiment shown in FIG. 4 with a known putter positioned to the right of the golf ball.

With practice, the golfer can train herself to coordinate the perceived distance between primary indicia with different amounts of force to be applied to the ball for different putt lengths. For example, for a short putt the ball is preferably positioned so that two primary indicia closest to the point of contact are perceived as being closely spaced. This can be achieved in one and/or two ways. The golfer can rotate the ball in order to change the perceived position of the primary indicia relative to each other, e.g. for a short putt the two more closely spaced together are positioned closest to the point of contact. As illustrated in FIG. 5, the two primary indicia 113 and 112 more closely spaced together are positioned closest to the point of contact. FIG. 5 illustrates a putter 116 positioned to the right of the two closest primary indicia 112 and 113. FIG. 6 illustrates the golf ball 110 rotated so that the further spaced primary indicia 111 and 112 are positioned closest to the point of contact. Alternatively, or together with the relative positioning of the primary indicia relative to the point of contact or alternatively, the golfer can also rotate the ball so that the primary indicia closest to the point of contact is positioned at or very close to the point of contact. By positioning the primary indicia in this way, the primary indicia closest to the point of contact and the primary indicia closest to that one will appear closer to each other when viewed from above by the golfer, as illustrated in FIG. 3. Thus in this way, the perceived distance between primary indicia and thereby the impression of how much force should be applied with the putt, can be readily adjusted i.e. the greater the perceived distance, the greater the force. This will further aid the golfer in applying the proper amount of force to putts of different lengths.

Preferably, when a golfer is making a shorter putt, the golfer positions the more closely spaced primary indicia 112 and 113 closer to the point of contact with indicia 111 at or closer to the top of the ball, as illustrated in FIG. 5. When a golfer has a longer putt, the further spaced primary indicia 111 and 112 of the golf ball 110 are positioned closer to the point of contact and indicia 113 is positioned at or closer to the top of the ball, as illustrated in FIG. 6.

Figure 24:
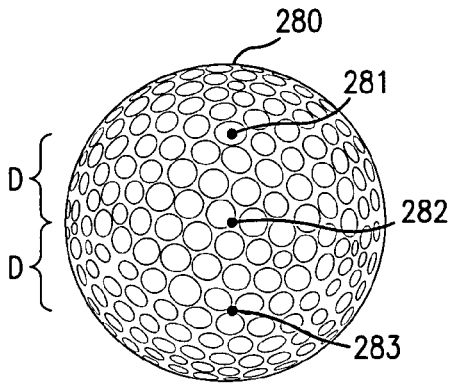
FIG. 24 is a perspective view of another embodiment of the present invention comprising evenly spaced primary indicia.

According to another embodiment of the present invention as illustrated in FIG. 24, golf ball 280 comprises a first primary indicia 281 which is spaced a distance D from a second primary indicia 282, and a third primary indicia 283 which is spaced a distance D from the second primary indicia 282. The spacing distances D are measured from the center of primary indicia 281 or 282 to the center of primary indicia 282 or 283, respectively. In this embodiment, these spacing distance D between primary indicia 281 and 282, and the spacing distance between primary indicia 282 and 283 are the same. For example, in this illustrated embodiment, suitable spacing distances D can be approximately 0.4 inches. In this illustrated embodiment, the spacing from the center of the first primary indicia 281 to the center of the third primary indicia 283 can be approximately 0.8 inches. The exact measurements of the spacing distances D can be varied within the scope of the present invention.

According to another embodiment of the present invention, a golf ball comprises at least three distinct and evenly spaced primary indicia which are positioned entirely within one quadrant of a golf ball and the remaining quadrants of a golf ball are devoid of any instructional indicia. As used herein, "instructional indicia" refers to any indicia which assists a golfer in aligning the golf ball or properly putting the golf ball.

According to yet another embodiment of the present invention, a first set of distinct and evenly spaced primary indicia are disposed in one quadrant of the golf ball and a second set of distinct and evenly spaced primary indicia are disposed in a second quadrant of the golf ball. In this embodiment, the second quadrant is positioned opposite the quadrant having the first set of evenly spaced primary indicia. In a preferred version of this embodiment all primary indicia are aligned on a circumference.

Figure 22A:
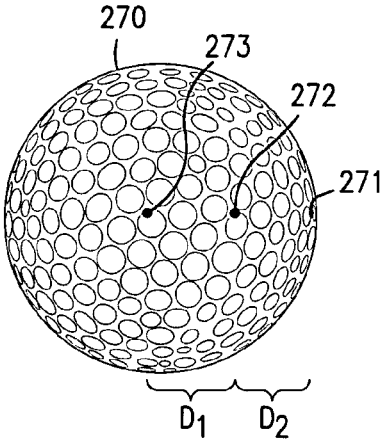
FIG. 22A is a top perspective view of another embodiment of the present invention.
Figure 22B:
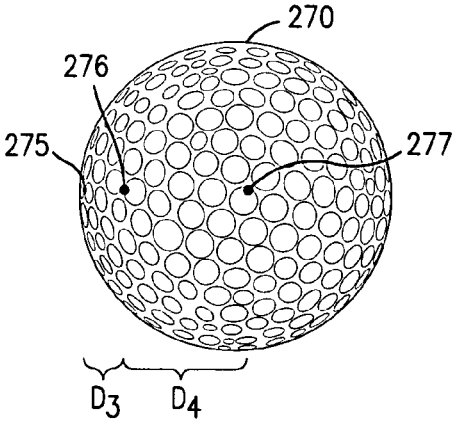
FIG. 22B is a bottom perspective view of the embodiment illustrated in FIG. 22A.

As noted below, the actual spacing between the primary indicia can be different on different balls, or even on different sides of the ball. Therefore, a golfer can carry a plurality of balls for putting and select which ball to use for putts of different lengths. As illustrated in FIGS. 1 and 2, the difference between spacing distances $D_1$ and $D_2$, and spacing distances $D_3$ and $D_4$ can be varied on different balls. Alternatively, as illustrated in FIGS. 22A and 22B, the spacing distances $D_1$ and $D_2$, and the spacing distance $D_3$ and $D_4$, can be varied on different sides of the same ball. FIG. 22A is a top view of golf ball 270 which comprises a first set of primary indicia 271, 272 and 273 with spacing distance $D_1$ and spacing distance $D_2$. FIG. 22B is a bottom view of golf ball 270 illustrating a second set of primary indicia 275, 276 and 277 with spacing distance $D_3$ and spacing distance $D_4$. This difference in spacing provides a golfer with different visual impressions, which aid in determining the amount of force that should be applied to a given putt.

The indicia on the golf ball also assist a golfer in squaring a putter to the golf ball. This is done by placing the putter behind the golf ball and visually aligning a line on the putter with the indicia on the golf ball closest to the point of contact as illustrated in FIGS. 5 and 6. The golfer can then strike the ball while envisioning that she is hitting either indicia 111 or indicia 113 (depending on whether it should be a short putt or a long putt,) into the middle indicia 112, and then the other indicia 113 or 111.

Figure 26:
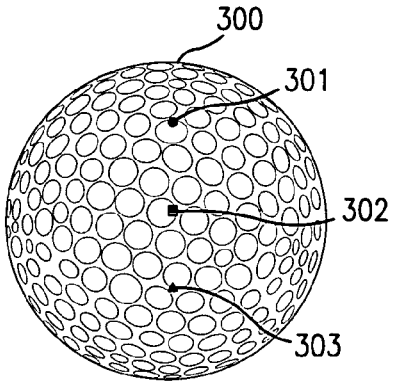
FIG. 26 is a perspective view of an embodiment of the present invention where the primary indicia are all different shapes.

In the first embodiment of FIG. 1, the three primary indicia 11, 12 and 13 are illustrated as circles or dots. However, the primary indicia can be any different geometric shape such as, but not limited to, triangular shapes, squares, arrows, or ovals. Each of the primary indicia on a golf ball can have the same shape. Alternatively, at least one of the primary indicia on a golf ball can have a different shape from the other primary indicia on the same ball. For example, one of the primary indicia can be a circle and the remaining primary indicia can be ovals. In another embodiment, each of the primary indicia on a single golf ball can have different shapes. For example, as illustrated in FIG. 26, a golf ball 300 comprising three primary indicia comprises one primary indicia in the shape of a circle 301, another in the shape of a square 302, and another in the shape of a triangle 303. In addition, different golf balls can have primary indicia which are different shapes. For example, one golf ball can have primary indicia that are all circles and another golf ball can have primary indicia that are all squares or a mix of shapes, colors and/or sizes. Primary indicia are preferably distinct shapes and not letters.

Figure 27:
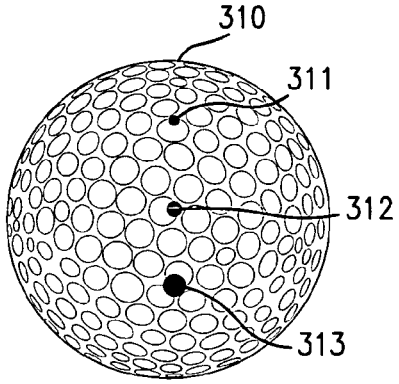
FIG. 27 is a perspective view of an embodiment of the present invention where each of the primary indicia is a different size.

In the first illustrated embodiment, the three primary indicia are the same size. The three indicia are optimally sized so that a golfer can visually align the indicia with the intended ball path when the golfer is placing the golf ball 10 on the green. It is preferable that the indicia are not too large so as to make it difficult for the golfer to visually align the indicia with the intended ball path. It is also preferable that the indicia are not too small so that the indicia can be readily seen by the golfer when she is standing over the golf ball 10 and ready to putt. For example, the diameter of each of the circular primary indicia 11, 12 and 13 can suitably be approximately 0.05 inches. However, each of the primary indicia on a golf ball can be different sizes. For example, at least one of the primary indicia on a golf ball can be a different size than the other primary indicia on the same ball. Alternatively, as illustrated in FIG. 27, each of the primary indicia 311, 312 and 313 on a single golf ball 310 have different sizes. In addition, different golf balls may have primary indicia that are different sizes. For example, some golf balls may have primary indicia that are a different size than the primary indicia on other golf balls.

The primary indicia 11, 12 and 13 in the first embodiment are illustrated as having the same color. However, the primary indicia on a golf ball can be different colors. For example, at least one of the primary indicia on a golf ball can be a different color than the other primary indicia on the same golf ball. In addition, each of the primary indicia on a golf ball can be different colors. Alternatively, different golf balls can have indicia having different colors. For example, one golf ball can have primary indicia which are all the same color and another golf ball can have primary indicia that are all a different color than the first golf ball. Each of the primary indicia also preferably has the same color intensity or brightness.

It is preferable, but not required, that the primary indicia are the same size, shape and color intensity.

Another embodiment of the present invention is directed to a golf ball comprising at least three distinct primary indicia aligned on a circumference of the golf ball. According to this embodiment, there are no other indicia on the same circumference on which the primary indicia are aligned.

Another embodiment of the present invention is directed to a golf ball comprising at least three distinct primary indicia aligned on an outer surface of the golf ball. A first primary indicia is spaced a first distance from a second primary indicia, and the second primary indicia is spaced a second distance from a third primary indicia. In this embodiment, the first distance and the second distance are at least 0.5 inches. In one such embodiment the first and second distances D are the same and approximately 0.5 inches. In another embodiment, the first and second distances are different.

Yet another embodiment of the present invention is directed to a golf ball comprising at least three primary indicia aligned on a circumference of a golf ball. A first primary indicia is spaced a first distance from a second primary indicia, and the second primary indicia is spaced a second distance from a third primary indicia. In this embodiment, at least one of the first distance or the second distance is greater than or equal to three times the length of one of the primary indicia as measured along the circumference on which the indicia are aligned. In another embodiment, both the first distance and the second distance are at least this long. In yet another embodiment, both the first distance and the second distance are at least four times the length of one of the primary indicia measured as noted above. As illustrated in FIG. 1, both the first distance $D_1$ and the second distance $D_2$ are greater than four times the length of primary indicia 11 as measured along the circumference on which the three primary indicia are aligned.

Figure 4:
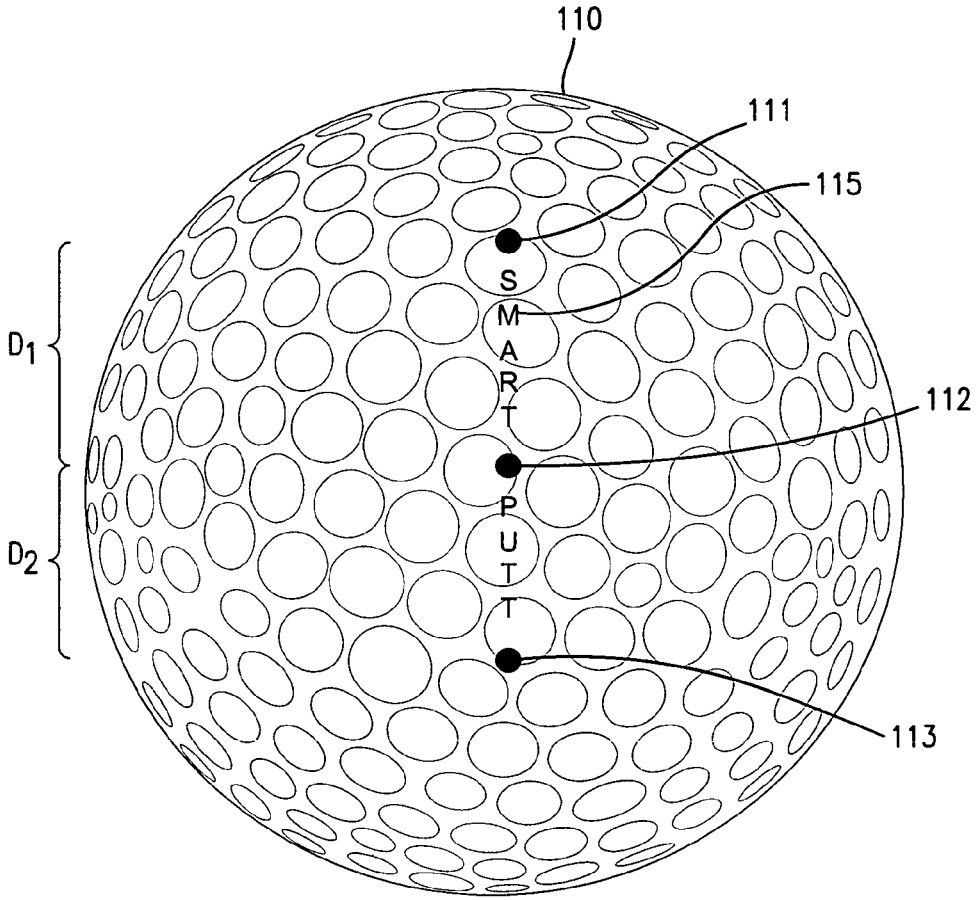
FIG. 4 is a perspective view of a third embodiment of the present invention.

Yet another embodiment of the present invention, as illustrated in FIG. 4, comprises a golf ball 110 comprising three primary indicia 111, 112 and 113 that are aligned on the surface of the golf ball 110. The spacing distance between indicia 111 and 112 is identified as $D_1$ and the spacing distance between indicia 112 and 113 is identified as $D_2$. In this illustrated embodiment spacing distances $D_1$ and $D_2$ are different.

The golf ball of this illustrated embodiment further comprises some supplemental indicia 115. Supplemental indicia are visually discernably different from the primary indicia. In preferred embodiments, the primary indicia are more readily visibly discernible than the supplemental indicia. Each of the primary indicia also preferably has the same color intensity. The supplemental indicia also preferably have one color intensity; however, the supplemental indicia may be lighter in color intensity than the color intensity of the primary indicia. As used herein, the term color intensity refers to the brightness of a hue. In FIG. 4, the supplemental indicia 115, SMART and PUTT are imprinted upon the golf ball 110 in a color intensity that is lighter than the color intensity of primary indicia 111, 112 and 113. Process inks are generally measured in percentages. The maximum intensity of any ink is 100 percent, and the minimum is zero percent. For example, the supplemental indicia can be imprinted at 50% black color so that they appear as a medium grey color and the three primary indicia 111, 112 and 113 are imprinted at 100% black color. This provides a contrast between the supplemental indicia and the primary indicia.

The supplemental indicia can be, for example, words, letters, numbers, line(s), discontinuous lines, points, circles, dots, arrows, or any combination of these examples. The supplemental indicia, however, need not be limited to any of these examples.

The supplemental indicia can be positioned all or partially in one or both of the spaces between two or more of the primary indicia. The supplemental indicia can also be disposed proximate the first primary indicia or the third primary indicia but not between the primary indicia. As used herein, "between primary indicia" is not intended to include the remaining circumference of the golf ball, i.e. the spacing between the first primary indicia and the third primary indicia that does not span over the second primary indicia. In addition, as used herein, "between primary indicia" refers to the space separating two adjacent primary indicia. This space is the area defined by an imaginary line drawn from the right side of the first primary indicia to the right side of the adjacent primary indicia and a second line drawn on the left side of the first primary indicia to the left side of the adjacent primary indicia. As used herein, "generally between primary indicia" is not intended to be limited to the area defined as "between primary indicia" and includes proximate space. The supplemental indicia is preferably disposed between the primary indicia, generally between the primary indicia and/or proximate the first primary indicia and the third primary indicia.

In one preferred embodiment, the supplemental indicia are aligned generally between the first and second primary indicia and between the second and third primary indicia. In another embodiment, the supplemental indicia are not aligned, but rather the supplemental indicia are disposed in any manner partially or entirely within the spaces between the first and second primary indicia and the second and third primary indicia, and/or extend past the first primary indicia or the third primary indicia.

In the embodiment illustrated in FIG. 4, the supplemental indicia 115 comprises the word SMART positioned between the first primary indicia 111 and the second primary indicia 112 and the word PUTT positioned between the second primary indicia 112 and the third primary indicia 113.

Figure 7:
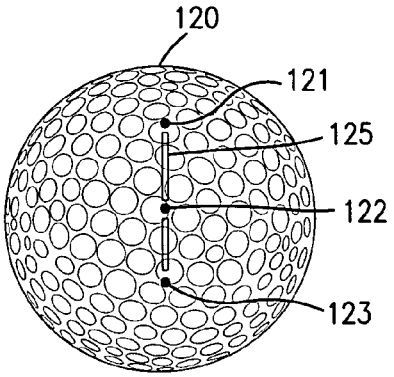
FIGS. 7 through 21 are perspective views of alternate embodiments of the present invention.
Figure 8:
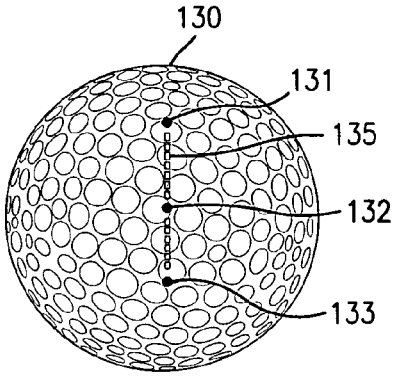

In another illustrated embodiment as shown in FIG. 7, the supplemental indicia 125 on golf ball 120 comprises a line positioned between the first primary indicia 121 and the second primary indicia 122 and another line positioned between the second primary indicia 122 and the third primary indicia 123. FIG. 7 illustrates the supplemental indicia 125 as outlines of rectangles; however, the supplemental indicia is preferably solid. The supplemental indicia is illustrated in this manner in the figures to indicate that the supplemental indicia 125 has a lighter color intensity than the primary indicia 121, 122 and 123. In FIGS. 8-12 and 16-21, the supplemental indicia are also illustrated as being outlined shapes. The supplemental indicia is most preferably solid. However, the supplemental indicia is illustrated in this manner to indicate that the supplemental indicia has a lighter color intensity that the primary indicia. In the embodiment of FIG. 7, the lines 125 do not intersect with the primary indicia 121, 122, 123; however, according to other embodiments of the invention, the supplemental indicia may intersect with the primary indicia. In an embodiment where the supplemental indicia intersect with the primary indicia, the primary indicia are still distinct and readily visibly discernable.

As illustrated in FIGS. 8-21, the supplemental indicia may comprise various geometric shapes positioned between the first primary indicia and the second primary indicia, and between the second primary indicia and the third primary indicia. The supplemental indicia 135 of the golf ball 130 of FIG. 8 comprises a plurality of closely spaced squares positioned between the primary indicia 131, 132 and 133.

Figure 9:
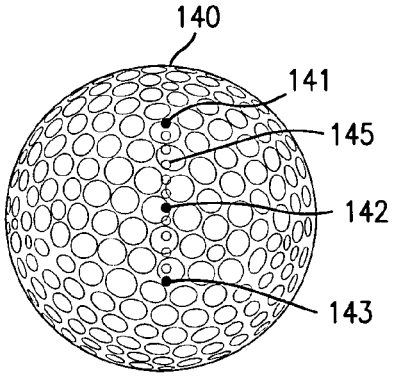

In FIG. 9, the supplemental indicia 145 on golf ball 140 comprises a plurality of solid circles positioned between primary indicia 141, 142, and 143.

Figure 10:
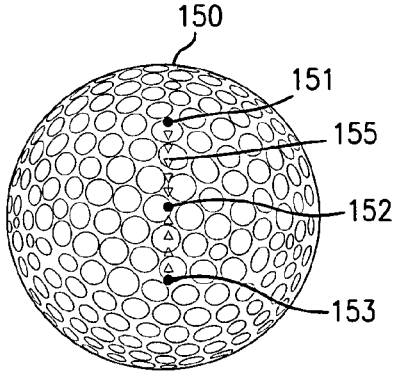

In FIG. 10, the supplemental indicia 155 of golf ball 150 comprises a plurality of triangles positioned between the first primary indicia 151 and second primary indicia 152 with the points of the triangles facing the second primary indicia 152, and a plurality of triangles positioned between the second primary indicia 152 and third primary indicia 153 with the points of the triangles facing the second indicia 152.

Figure 11:
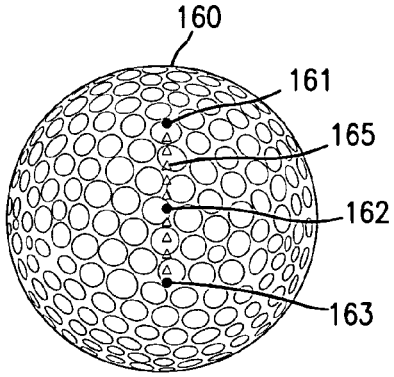

In FIG. 11, the supplemental indicia 165 of golf ball 160 comprises a plurality of triangles all facing the same direction positioned between primary indicia 161, 162 and 163.

Figure 12:
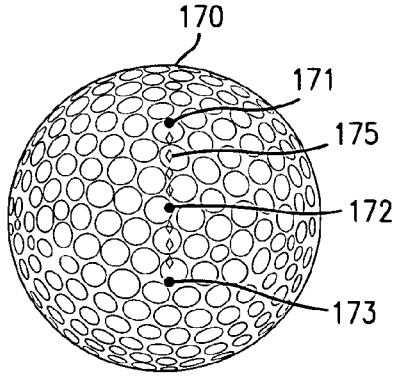

In FIG. 12, the supplemental indicia 175 of golf ball 170 comprises a plurality of diamonds positioned between the primary indicia 171, 172 and 173.

Figure 13:
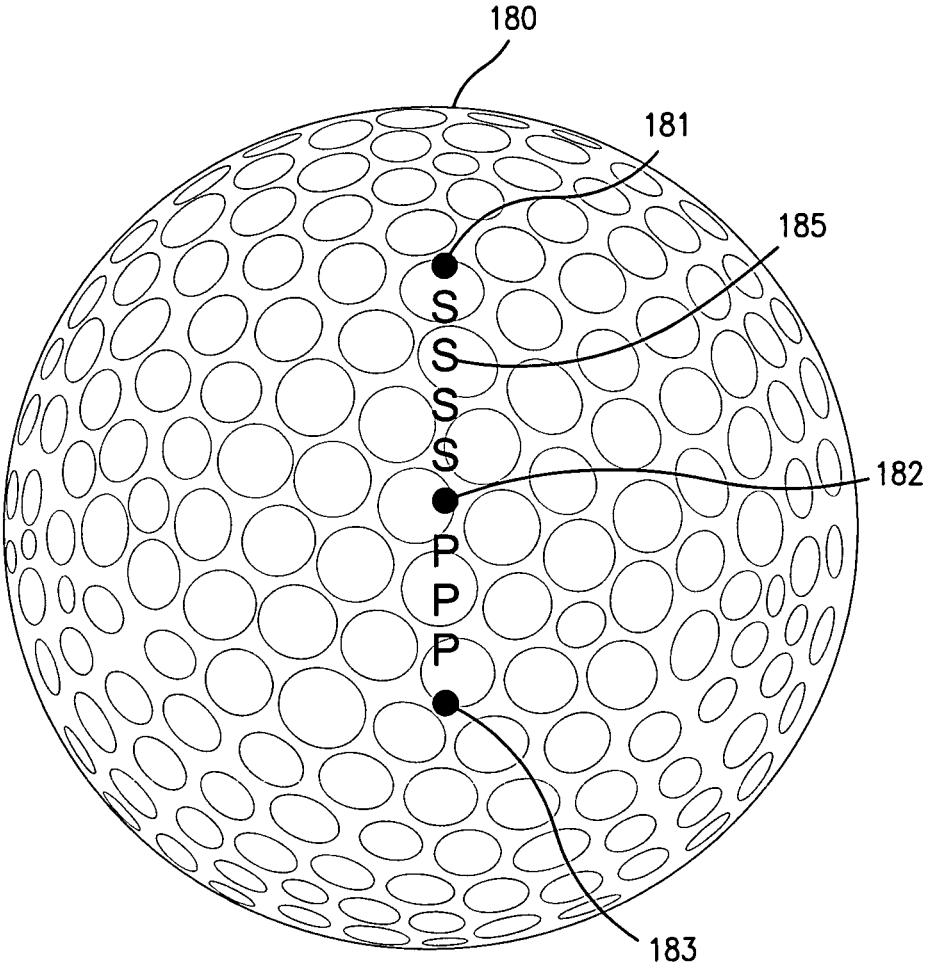
Figure 14:
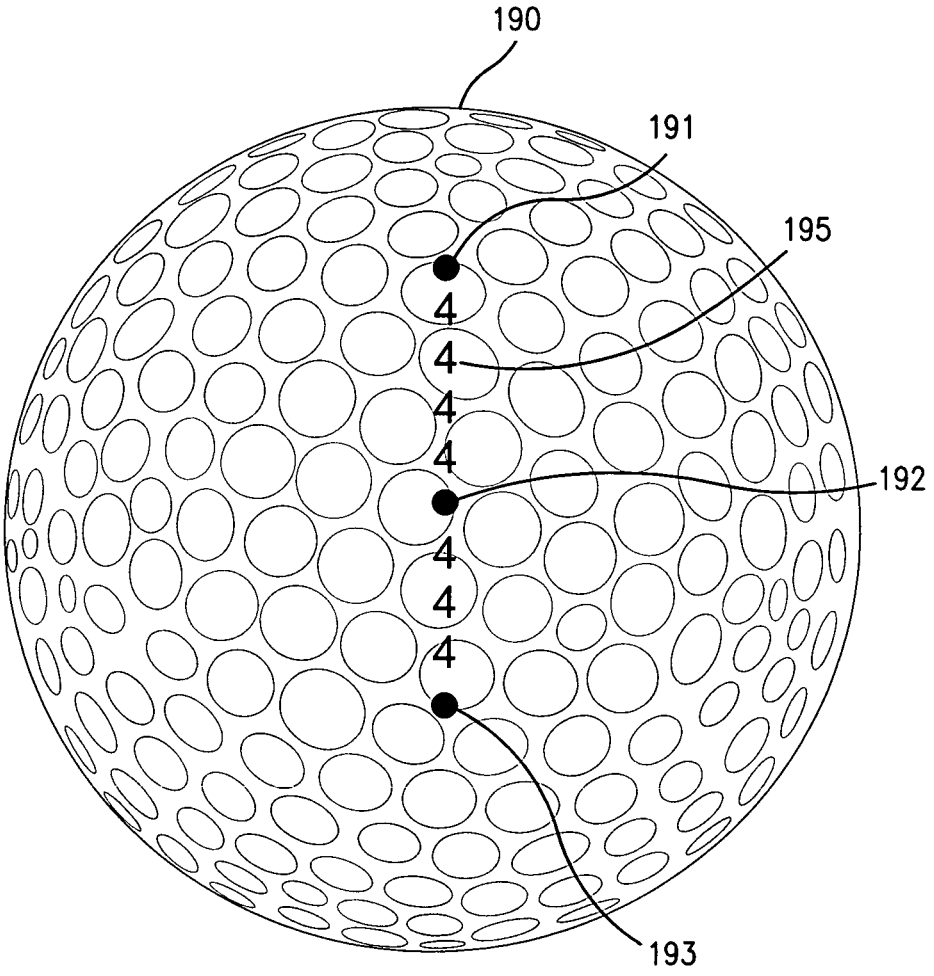

According to another embodiment, as illustrated in FIG. 13, the supplemental indicia 185 of golf ball 180 comprises a plurality of the letters "S" positioned between the first primary indicia 181 and second primary indicia 182 and a plurality of the letters "P" positioned between the second primary indicia 182 and third primary indicia 183. The supplemental indicia of this illustrated embodiment are not limited to these specific letters and can include any letters, numbers, or combination of letters and numbers. For example, the golf ball 190 illustrated in FIG. 14 comprises supplemental indicia 195 comprising a plurality of the number "4" positioned between the primary indicia 191, 192 and 193.

Figure 15:
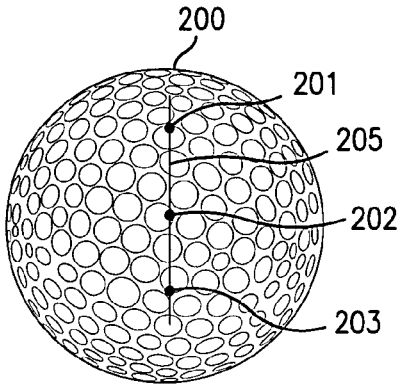
Figure 16:
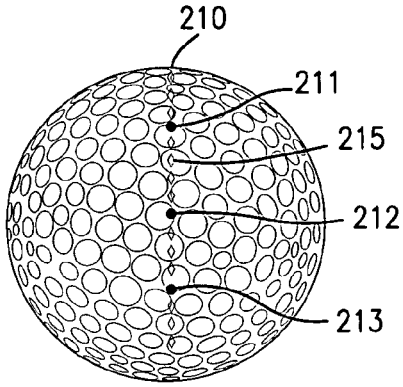
Figure 17:
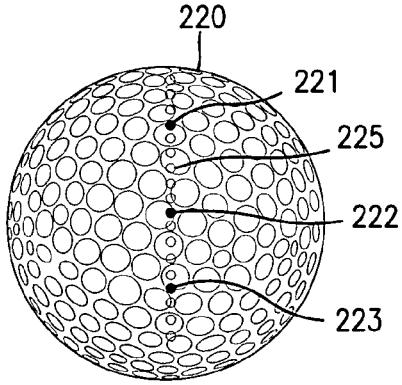

In addition, the supplemental indicia does not need to be positioned within the spacing between the first and second primary indicia and the second and third primary indicia. The supplemental indicia may extend through the first, second and/or third primary indicia and can also extend beyond the first and/or third primary indicia. According to another embodiment, as illustrated in FIG. 15, the supplemental indicia 205 of golf ball 200 comprises a line extending through each of the primary indicia 201, 202 and 203 and extending beyond the first primary indicia 201 and third primary indicia 203. According to yet another embodiment of the invention, as illustrated in FIGS. 16 and 17, the supplemental indicia comprise different shapes which are positioned past the first primary indicia and third primary indicia as well as within the spaces between the first primary indicia and second primary indicia and the spaces within the second primary indicia and third primary indicia. In FIG. 16, the supplemental indicia 215 of golf ball 210 comprises a plurality of diamonds positioned between primary indicia 211, 212 and 213, and in FIG. 17, the supplemental indicia 225 of golf ball 220 comprises a plurality of dots positioned between primary indicia 221, 222, and 223.

According to yet other embodiments, as illustrated in FIGS. 18-21, the supplemental indicia may be positioned in various arrangements between the primary indicia and/or beyond the first and third primary indicia.

Figure 18:
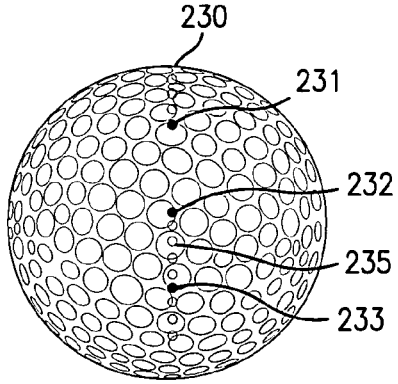

In FIG. 18, the supplemental indicia 235 of golf ball 230 comprises a plurality of circles positioned between primary indicia 232 and 233 and a plurality of circles positioned proximate primary indicia 231 and 233.

Figure 19:
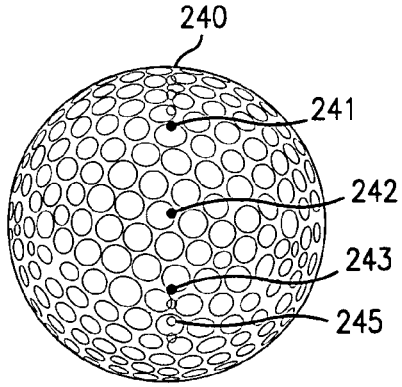

In FIG. 19, the supplemental indicia 245 of golf ball 240 comprises a plurality of indicia positioned proximate indicia 231 and 233. There are no supplemental indicia between primary indicia 241 and 242 and primary indicia 242 and 243.

Figure 20:
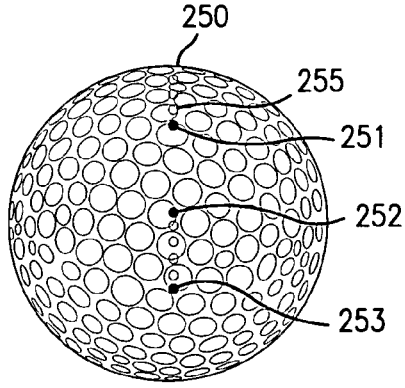

In FIG. 20, the supplemental indicia 255 of golf ball 250 comprises a plurality of circles positioned proximate primary indicia 251 and a plurality of circles positioned between primary indicia 252 and 253.

Figure 21:
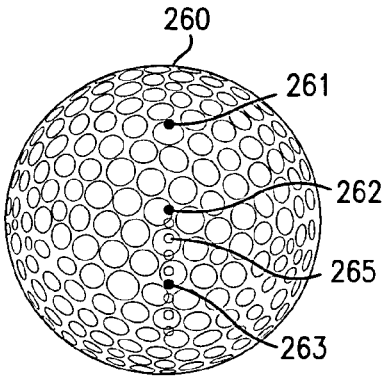

In FIG. 21, the supplemental indicia 265 of golf ball 260 comprises a plurality of circles positioned between primary indicia 262 and 263 and proximate primary indicia 263. There are no supplemental indicia between primary indicia 261 and 262 in this embodiment.

The placement of the supplemental indicia such as words SMART and PUTT as illustrated in FIG. 4 are intended to provide a psychological boost to the golfer, helping the golfer to think positively, giving the golfer added confidence and helping the golfer to relax, when aligning the golf ball and putting. The intensity of the supplemental indicia is preferably light enough so that when the golfer is standing over the ball ready to putt, the words or other supplemental indicia are less likely to be a distraction to a golfer focusing on the primary indicia.

Similarly to the primary indicia, the supplemental indicia can also be imprinted in different colors. For example, the supplemental indicia on a given golf ball can be in a different color than the primary indicia. Alternatively, in another embodiment, the supplemental indicia on a golf ball can be different colors. For example, the word "SMART" can appear in a different color than the word "PUTT" or each of the letters in the words "SMART" and "PUTT" can be different colors. In addition, different balls can have supplemental indicia which are in different colors.

The invention claimed is:

1. A golf ball comprising an alignment guide for aiding a player to properly hit the golf ball with a desired amount of force and with a desired angle of club head movement, comprising:

said golf ball comprising an outer surface;

said alignment guide comprising at least three distinct primary indicia aligned on said outer surface along a circumference of said golf ball, said at least three primary indicia comprising a first primary indicia, a second primary indicia and a third primary indicia;

wherein the center of said first primary indicia is spaced a first distance from the center of said second primary indicia along said circumference of said outer surface, the center of said second primary is spaced a second distance from the center of said third primary indicia along said circumference of said golf ball, wherein said first distance is different from said second distance;

wherein there are no other indicia positioned between said primary indicia which have a color intensity which is greater than or equal to the color intensity of any of said primary indicia; and wherein the center of said first primary indicia is about 0.5 inches from the center of said second primary indicia and the center of said second primary indicia is about 0.4 inches from the center of said third primary indicia.

2. A golf ball according to claim 1 wherein said golf ball comprises four quadrants and each of said first, second and third primary indicia are all aligned on said golf ball within one of said quadrants.

3. A golf ball according to claim 2 wherein said first primary indicia and said third primary indicia are disposed within an arc of less than ninety degrees.

4. A golf ball according to claim 2 wherein said first primary indicia and said third primary indicia are disposed within an arc of about twenty degrees to about eighty degrees.

5. A golf ball according to claim 2 wherein said first primary indicia and said third primary indicia form an arc of approximately forty-five degrees to approximately seventy degrees.

6. A golf ball according to claim 1 wherein said first primary indicia and said third primary indicia are disposed within an arc of less than one hundred eighty degrees.

7. A golf ball according to claim 1 wherein each of said primary indicia are in a shape selected from the group consisting of a circle, a triangle, a square, an arrow and an oval.

8. A golf ball according to claim 1 wherein each of said primary indicia are circular.

9. A golf ball according to claim 1 wherein said primary indicia are imprinted on said golf ball.

10. A golf ball according to claim 1 wherein said first primary indicia comprises a color intensity and said second and third primary indicia comprises a color intensity that is the same as said color intensity of said first primary indicia.

11. A golf ball according to claim 1 wherein said first primary indicia, said second primary indicia, and said third primary indicia are the same shape.

12. A golf ball according to claim 1 wherein at least one of said primary indicia is a different shape than at least one other of said primary indicia.

13. A golf ball according to claim 1 wherein each of said primary indicia are a different shape.

14. A golf ball according to claim 1 wherein said first primary indicia, said second primary indicia, and said third primary indicia are the same size.

15. A golf ball according to claim 1 wherein at least one of said primary indicia is a different size than at least another one of said primary indicia.

16. A golf ball according to claim 1 wherein each of said primary indicia are a different size.

17. A golf ball according to claim 1 wherein said first primary indicia, said second primary indicia, and said third primary indicia are the same color.

18. A golf ball according to claim 1 wherein at least one of said primary indicia is a different color than at least another one of said primary indicia.

19. A golf ball according to claim 1 wherein each of said primary indicia are a different color.

20. A golf ball according to claim 1 further comprising supplemental indicia on said golf ball disposed proximate said primary indicia.

21. A golf ball according to claim 20 wherein said supplemental indicia is at least partially disposed between said first and said second primary indicia and between said second and said third primary indicia.

22. A golf ball according to claim 20 wherein said supplemental indicia is aligned with said primary indicia.

23. A golf ball according to claim 20 wherein said supplemental indicia is selected from the group consisting of words, letters, numbers, solid lines, discontinuous lines, points, circles, dots and arrows.

24. A golf ball according to claim 1 further comprising supplemental indicia on said golf ball, said supplemental indicia disposed at least partially between said first and said second primary indicia and at least partially between said second and said third primary indicia, and aligned with said first primary indicia and said third primary indicia.

25. A golf ball according to claim 24 wherein at least one of said primary indicia comprises a first color intensity and said supplemental indicia comprises a color intensity that is lighter than said first color intensity.

26. A golf ball according to claim 1 further comprising supplemental indicia on said golf ball, said supplemental indicia disposed between at least two of said primary indicia, and said supplemental indicia also aligned with said primary indicia but not between said primary indicia.

27. A golf ball according to claim 26 wherein at least one of said primary indicia comprises a first color intensity and said supplemental indicia comprises a color intensity that is lighter than said first color intensity.

28. A golf ball according to claim 1 further comprising supplemental indicia on said golf ball, said supplemental indicia is at least partially disposed between at least two of said primary indicia, and said supplemental indicia is also aligned with said primary indicia but not disposed between all of said primary indicia.

29. A golf ball according to claim 28 wherein at least one of said primary indicia comprises a first color intensity and said supplemental indicia comprises a color intensity that is lighter than said first color intensity.

30. A golf ball according to claim 1 wherein said outer surface comprises a plurality of dimples and an outer rim, and wherein at least one of said primary indicia is at least partially disposed on one of said dimples.

31. A golf ball according to claim 30 wherein at least one of said primary indicia is disposed on at least one of said dimples and on said outer rim.

32. A golf ball comprising an alignment guide for aiding a player to properly hit the golf ball with a desired amount of force and with a desired angle of club head movement, comprising:

said golf ball comprising an outer surface;

said alignment guide comprising at least three distinct primary indicia aligned on said outer surface along a circumference of said golf ball, said at least three primary indicia comprising a first primary indicia, a second primary indicia and a third primary indicia;

wherein the center of said first primary indicia is spaced a first distance from the center of said second primary indicia along said circumference of said outer surface, the center of said second primary is spaced a second distance from the center of said third primary indicia along said circumference of said golf ball, wherein said first distance is different from said second distance;

wherein there are no other indicia positioned between said primary indicia which have a color intensity which is greater than or equal to the color intensity of any of said primary indicia;

supplemental indicia on said golf ball disposed proximate said primary indicia; and wherein said primary indicia comprises a first color intensity and said supplemental indicia comprises a color intensity that is lighter than said first color intensity.

33. A golf ball according to claim 32 wherein the center of said first primary indicia is about 0.4 inches to about 2.6 inches from the center of said third primary indicia.

34. A golf ball according to claim 28 wherein the center of said first primary indicia is about 0.7 inches to about 1.3 inches from the center of said third primary indicia.

35. A golf ball according to claim 32 wherein the center of said first primary indicia is about 0.8 inches from the center of said third primary indicia.

36. A golf ball according to claim 32 wherein the center of said first primary indicia is about 0.15 inches to about 1 inch from the center of said second primary indicia and the center of said second primary indicia is about 0.5 inches to about 2.4 inches from the center of said third primary indicia.

37. A golf ball according to claim 32 wherein the center of said first primary indicia is about 0.5 inches from the center of said second primary indicia and the center of said second primary indicia is about 0.4 inches from the center of said third primary indicia.

38. A golf ball according to claim 32 wherein both of said first distance and said second distance are at least three times the length of one of said primary indicia.

39. A golf ball according to claim 32 wherein said first distance and said second distance are each at least four times the length of one of said primary indicia.

40. A golf ball according to claim 32 wherein said primary indicia comprise a geometric shape and said supplemental indicia comprise at least part of an alphabet.

41. A golf ball according to claim 32 wherein said supplemental indicia comprise at least one word.

42. A golf ball according to claim 32 wherein said supplemental indicia are aligned with said primary indicia along said circumference.

43. A golf ball according to claim 32 wherein said primary indicia comprise solid circles.

44. A golf ball according to claim 32 wherein said golf ball comprises four quadrants and each of said first, second and third primary indicia are all aligned on said golf ball within one of said quadrants.

45. A golf ball according to claim 44 wherein said first primary indicia and said third primary indicia are disposed within an arc of less than ninety degrees.

46. A golf ball according to claim 44 wherein said first primary indicia and said third primary indicia are disposed within an arc of about twenty degrees to about eighty degrees.

47. A golf ball according to claim 44 wherein said first primary indicia and said third primary indicia form an arc of approximately forty-five degrees to approximately seventy degrees.

48. A golf ball according to claim 32 wherein said first primary indicia and said third primary indicia are disposed within an arc of less than one hundred eighty degrees.

49. A golf ball according to claim 32 wherein each of said primary indicia are in a shape selected from the group consisting of a circle, a triangle, a square, an arrow and an oval.

50. A golf ball according to claim 32 wherein each of said primary indicia are circular.

51. A golf ball according to claim 32 wherein said primary indicia are imprinted on said golf ball.

52. A golf ball according to claim 32 wherein said first primary indicia, said second primary indicia, and said third primary indicia are the same shape.

53. A golf ball according to claim 32 wherein at least one of said primary indicia is a different shape than at least one other of said primary indicia.

54. A golf ball according to claim 32 wherein each of said primary indicia are a different shape.

55. A golf ball according to claim 32 wherein said first primary indicia, said second primary indicia, and said third primary indicia are the same size.

56. A golf ball according to claim 32 wherein at least one of said primary indicia is a different size than at least another one of said primary indicia.

57. A golf ball according to claim 32 wherein each of said primary indicia are a different size.

58. A golf ball according to claim 32 wherein said first primary indicia, said second primary indicia, and said third primary indicia are the same color.

59. A golf ball according to claim 32 wherein at least one of said primary indicia is a different color than at least another one of said primary indicia.

60. A golf ball according to claim 32 wherein each of said primary indicia are a different color.

61. A golf ball according to claim 32 wherein said supplemental indicia is at least partially disposed between said first and said second primary indicia and between said second and said third primary indicia.

62. A golf ball according to claim 32 wherein said supplemental indicia is aligned with said primary indicia.

63. A golf ball according to claim 32 wherein said supplemental indicia is selected from the group consisting of words, letters, numbers, solid lines, discontinuous lines, points, circles, dots and arrows.

64. A golf ball according to claim 32 wherein said supplemental indicia is disposed at least partially between said first and said second primary indicia and at least partially between said second and said third primary indicia, and aligned with said first primary indicia and said third primary indicia.

65. A golf ball according to claim 32 wherein said supplemental indicia is disposed between at least two of said primary indicia, and said supplemental indicia also aligned with said primary indicia but not between said primary indicia.

66. A golf ball according to claim 32, said supplemental indicia is at least partially disposed between at least two of said primary indicia, and said supplemental indicia is also aligned with said primary indicia but not disposed between all of said primary indicia.

67. A golf ball according to claim 32 wherein said outer surface comprises a plurality of dimples and an outer rim, and wherein at least one of said primary indicia is at least partially disposed on one of said dimples.

68. A golf ball according to claim 32 wherein at least one of said primary indicia is disposed on at least one of said dimples and on said outer rim.

* * * * *